United States Patent [19]

Mittag

[11] 4,118,816

[45] Oct. 10, 1978

[54] CROSSOVER OR BRIDGE

[75] Inventor: Douglas C. Mittag, Bolingbrook, Ill.

[73] Assignee: Aurora Equipment Company, Aurora, Ill.

[21] Appl. No.: 839,840

[22] Filed: Oct. 6, 1977

[51] Int. Cl.[2] ..... E01D 1/00

[52] U.S. Cl. ..... 14/69.5; 182/106; 52/182

[58] Field of Search ..... 14/1, 69.5; 182/106; 256/1, 14; 52/182, 188

[56] References Cited

U.S. PATENT DOCUMENTS

| | | | |
|---|---|---|---|
| 499,699 | 6/1893 | Barnes | 14/1 X |
| 853,134 | 5/1907 | Steiber | 52/182 |
| 1,232,437 | 7/1917 | Simpson | 14/69.5 |
| 1,497,703 | 6/1924 | Stillman | 14/1 |
| 1,593,999 | 7/1926 | Bingham | 14/1 |
| 2,726,123 | 12/1955 | Mathews | 14/69.5 X |
| 2,867,855 | 1/1959 | Xanten | 52/182 X |
| 2,927,396 | 3/1960 | Hall | 14/1 X |
| 3,565,210 | 2/1971 | Evans | 182/106 |
| 4,023,647 | 5/1977 | Confer | 182/106 X |

*Primary Examiner*—Nile C. Byers, Jr.

*Attorney, Agent, or Firm*—Hill, Gross, Simpson, Van Santen, Steadman, Chiara & Simpson

[57] ABSTRACT

A crossover or bridge for shipment as a compact unit for assembly at an installation site comprising a bridge section and a pair of stairways for connection with opposite ends of the bridge section. The bridge section is disposed in an elevated position relative to bottom ends of the stairways when assembled therewith for spanning an object. The bridge section comprises a pair of transversely spaced crossover panels with a grating or decking carried thereon. Readily assembled joint means are provided between the stairways and the bridge section at its opposite ends.

17 Claims, 6 Drawing Figures

CROSSOVER OR BRIDGE

BACKGROUND OF THE INVENTION

1. Field of the Invention

This invention relates to a crossover or a bridge for spanning various types of objects such as a conveyor in a plant or such as a pipeline in the field. The crossover or bridge has been particularly constructed so that it can be shipped in a knockdown form for assembly at the job site.

2. Prior Art

In industrial plants where long-production lines are to be crossed, it is common in industry to employ a gate or to provide a section in the conveyor that can be lifted. This sort of an arrangement is reasonably satisfactory where the production line or the conveyor is not loaded but is not feasible where loaded for production would then be interrupted if the conveyor had to be shut down and/or unloaded. In oil field applications, where there are earthen embankments around the individual oil storage tanks, these embankments are sometimes formed by a bulldozer and are provided to prevent spill from the tank leading into another tank for fire protection purposes. Currently, in the situations known to applicant, it is necessary for the workman to climb over the earthen embankments or around the earthen embankment where it is desired to conveniently travel from one tank to the next.

SUMMARY OF THE INVENTION

The crossover is provided with a bridge section and a pair of angled stairways for connection with opposite ends of the bridge section. The bridge section is disposed in an elevated position relative to bottom ends of the angled stairways when assembled therewith. Quick-attachment fasteners are provided to enable the angled stairways to be assembled with the bridge section in a field. The components of the crossover are so constructed as to enable them to be shipped in a compact form to minimize shipping costs.

The crossover is comprised of a pair of transversely spaced main crossover panels that are positioned at opposite ends of the bridge section. A railing structure is provided at opposite sides of the crossover and more particularly a railing is attached to each of the crossover panels, in accordance with certain features of this invention.

According to other features of this invention, a riser panel end section is provided at upper ends of a pair of spaced supported side rails which comprise components of the stairways. A shelf structure or bracket is mounted on each riser panel end section for supporting the main crossover panel. One of these shelf structures or brackets is provided on an upper end of each of the side rails. These brackets are joined by fasteners to secure the opposite ends of each main crossover panel to the associated riser panel end sections. It is in this way that the main crossover panels are secured in separated relation with the upper ends of the stairways. A crossover grating is positioned between the main crossover panels and secured in assembly therewith to enable a person to travel over the bridge section.

It is an object of this invention to provide a knockdown crossover or bridge unit that can be compactly shipped and readily assembled at a minimum cost and which crossover or bridge lends itself for use as a means to enable personnel to readily cross production lines when used in an industrial plant and which further enables personnel to readily crossover various types of obstructions when used in the field.

It is a further object of this invention to provide a bridge or crossover that lends itself for use for spanning an obstruction and where the elevation on opposite sides of the obstruction is uneven.

Still, another object of this invention is to provide a bridge or crossover construction where the bridge section can be supported in suspension between upper opposite ends of stairways assembled therewith as the sole means of support.

Other objects and features of this invention will more readily become apparent in view of the following detailed description of the various embodiments of the invention and the further description of the crossover or bridge following thereafter.

ON THE DRAWINGS

AS SHOWN ON THE DRAWINGS

Figure 1:
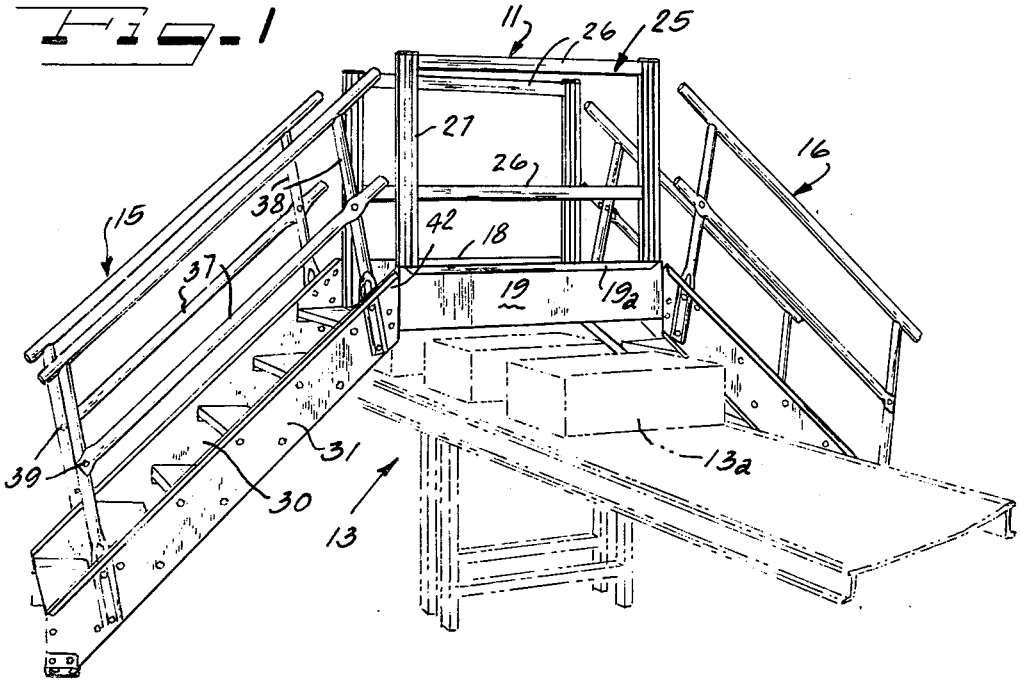
FIG. 1 is a front perspective view of a bridge or crossover shown with a bridge section spanning over a loaded conveyor which conveyor is shown in dotted lines.

The principles of the present invention are particularly useful when embodied in a crossover or a bridge as shown in FIG. 1, generally indicated by the numeral 10. The illustrated crossover or bridge is particularly adapted for being manufactured and shipped whereby the components are in a knockdown form and so that the components can be readily assembled in an industrial plant or in the field for various types of use as previously described. The crossover 10 comprises a bridge section 11 and a pair of stairways 12—12 which stairways are positioned at opposite ends of the bridge section and which serve as a sole means of support for the suspension of the bridge section therebetween so that the bridge section can overlie a conveyor 13 such as is illustrated in FIG. 1 by the dotted lines. The illustrated conveyor has articles 13*a* that are being transported thereon in a manner commonly found in industrial manufacturing plants.

Figure 5:
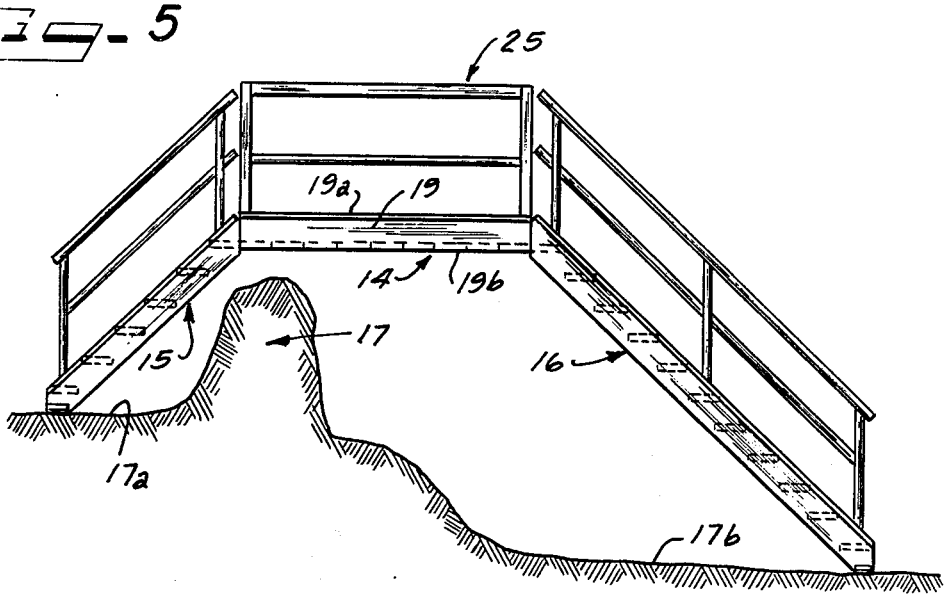
FIG. 5 is a side view of a modified type of crossover or bridge shown spanning an obstruction as used in the field.
Figure 6:
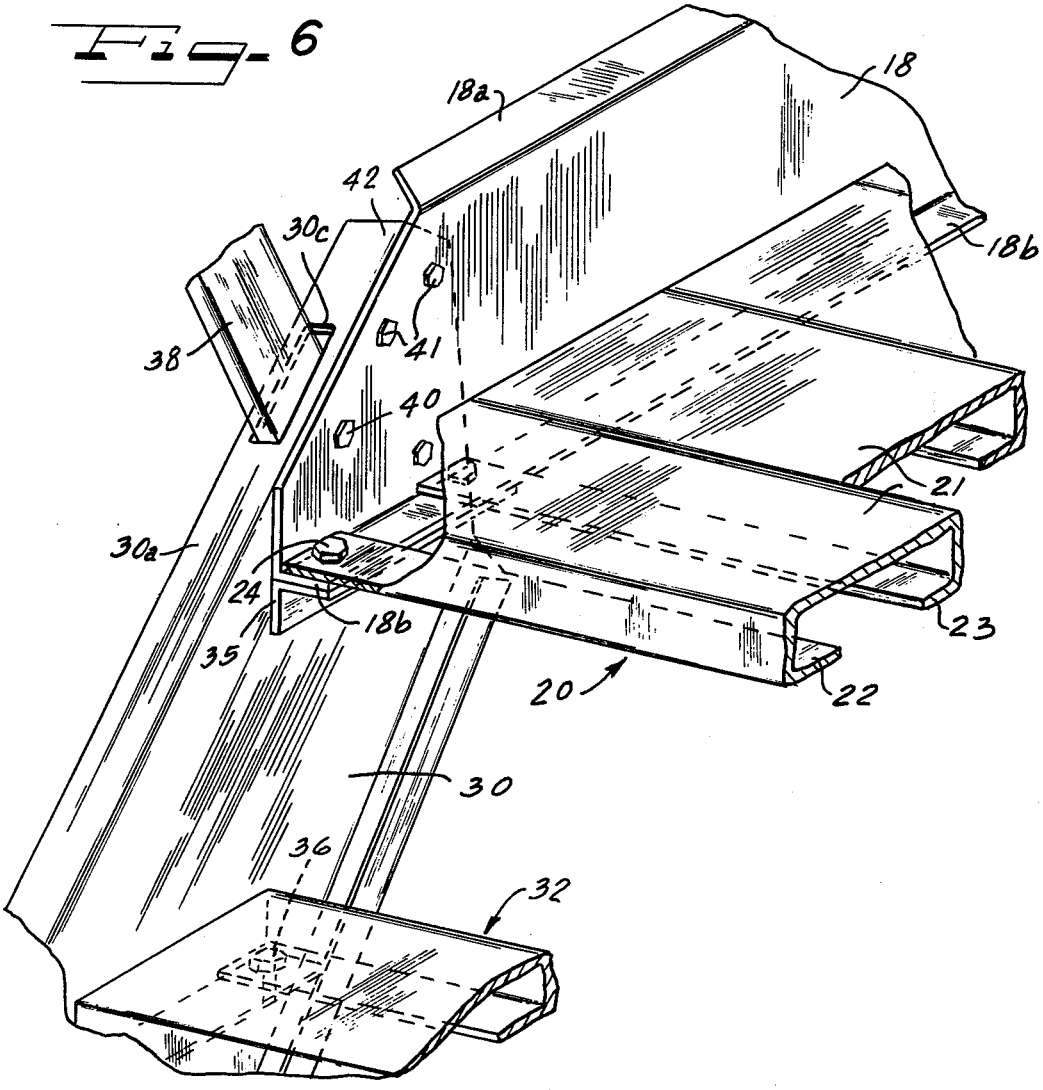
FIG. 6 is an enlarged fragmentary perspective view illustrating a joint connecting an upper end of a stairway with one end of a bridging section of a crossover or bridge.

In FIG. 5, is a modified crossover 14 that is identical to the crossover 10 except stairways 15–16 are of different lengths to span a rocket construction 17 where the terrain on opposite sides of the rock obstruction is at different elevations as shown at 17*a* and 17*b*. According to important features of this invention, the stairway lengths can be readily modified so that the crossover can be used in different types of arrangements for plant and field use.

The bridge section 11 includes a pair of transversely spaced main crossover panels 18 and 19. The construction of each is essentially identical although when assembled they are positioned 180° of one another. The cross-sectional configuration of each is identical. The manner of assembly of each is essentially identical with respect to the other components of the bridge section and of the stairways 12—12, the details of which will become more apparent from the description following.

The transversely spaced main crossover panels 18 and 19 are provided with outwardly angled or turned continuous flanges or margins 18*a* and 19*a* and inwardly angled turned continuous flanges or margins 18*b* and 19*b*. A grating structure 20 is mounted on the aforesaid flanges 18*b* and 19*b* of the transversely spaced main crossover panels 18 and 19. To this end, the grating structure 20 is comprised of a series of transversely extending channels 21 which are disposed in side-by-side right angular relation between the crossover panels 18 and 19 and are supported upon the inwardly angled or turned continuous flanges or margins 18*b* and 19*b*. These grating channels 21 have inwardly turned channel attachment flanges 22 and 23 and a series of nut and bolt fasteners 24 are provided to secure the aforesaid attachment flanges 22 and 23 to the inwardly angled or turned continuous flanges or margins 18*b* and 19*b* as is apparent from FIG. 2.

Mounted upon the bridge section 11 are crossover railings 25—25. The construction of the railings is identical and a description of one will suffice for both. Horizontal crossover railing member 26 are suitably secured by fasteners (not shown) to vertical crossover railing posts 27. The posts 27 are provided with post anchor plates 28 (FIG. 4) and fasteners 29 are provided to secure the anchor plates to the associated underlying grating channel 21.

The stairways 15 and 16 are essentially identical and a description of one is believed to be adequate for both. To this end, the stairway 15 has a pair of riser panels 30 and 31 which are of an identical cross-sectional configuration with one being rotated 180° of the other. The riser panel 30 includes upper and lower oppositely turned channel-shaped riser panel margins 30*a* and 30*b*. Mounted between the riser panels 30 and 31 are a series of channel shaped stair treads 32 with each stair tread having inwardly turned stair tread attachment flanges 33 and 34. Mounted upon the riser panels 30 and 31 on inside surfaces are a series of riser stair tread support angles 35 which are secured and bolted at assembly by means of fasteners with the attachment flanges 33 and 34 of the treads 32. It is in this manner that the stair treads can be readily secured with the riser panels 30 and 31 to enable quick assembly of the components of the stairway after being shipped in knockdown form to the point of installation.

In addition to the foregoing, the stairways 15 and 16 each have stairway railings which include horizontal stairway railing members 37 and vertical stairway post members 38. Suitable fasteners 39 are provided for securing the horizontal stairway railing members with the vertical stairway post members 38.

In order to effect assembly of the railings with the riser panels 30 and 31, the flanges 30*a* and 31*a* of the riser panels are slotted such as is indicated at 30*c* to enable lower ends of the stairway post members 38 to be extended therethrough and secured by means of nut and bolt fasteners 40 in assembled relation therewith.

In order to effect assembly of the stairways 12—12 with the bridge section 11, it will be noted that in opposite ends of the transversely spaced main crossover panels are shaped in a way so as to match the shape of upper riser panel end sections 42 and when said sections 42 are overlapped with the opposite ends of the panels 18 and 19, fasteners 41 are utilized to complete the assembly of the bridge section 11 with the stairways 12—12. In order to stabilize the joint thereby formed between the lapped portions just described, a multiplicity of the bolt and nut fasteners 41 are utilizing at each joint to prevent the components from rocking relative to one another.

When the spaced main crossover panels are assembled with the riser panels 30 and 31, the panels 18 and 19 are supported at opposite ends upon the riser stair tread support angles 35. As previously stated, the angles 35 are secured to the riser panels 30 and 31. When these components are in assembled relation, the underturned flange 18*b* of crossover panel 18 is bolted at 24 to the transversely extending channel 21 of the grating and also to the angle 35. Thus, the fasteners 24, are used to secure three components together in assembly at the opposite ends of the crossover panels 18 and 19.

Figure 4:
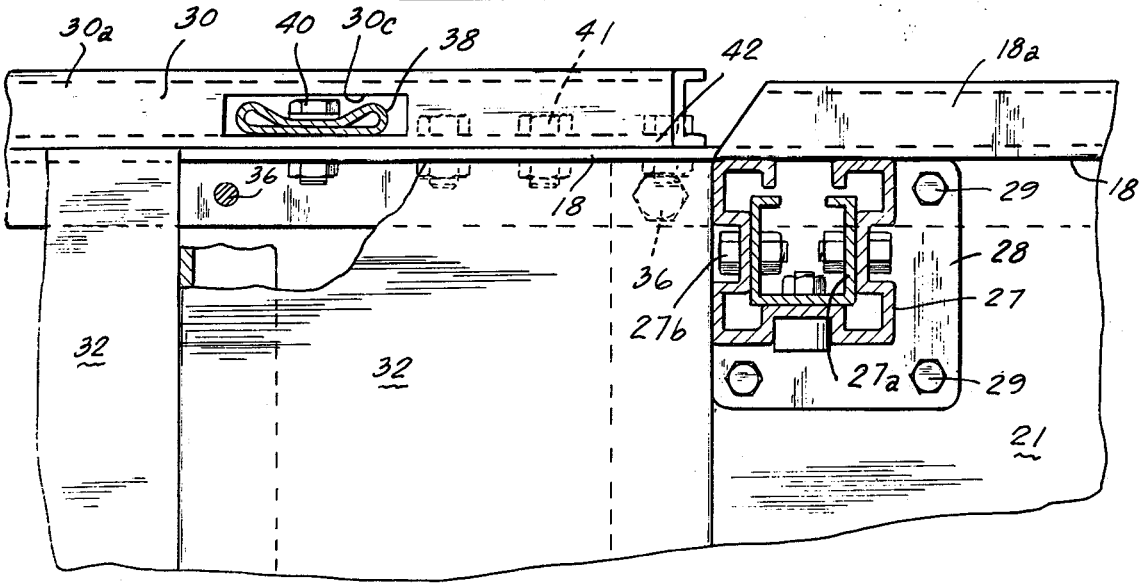
FIG. 4 is an enlarged fragmentary cross-sectional view taken on the line IV—IV looking in the direction indicated by the arrows as seen in FIG. 2.
Figure 2:
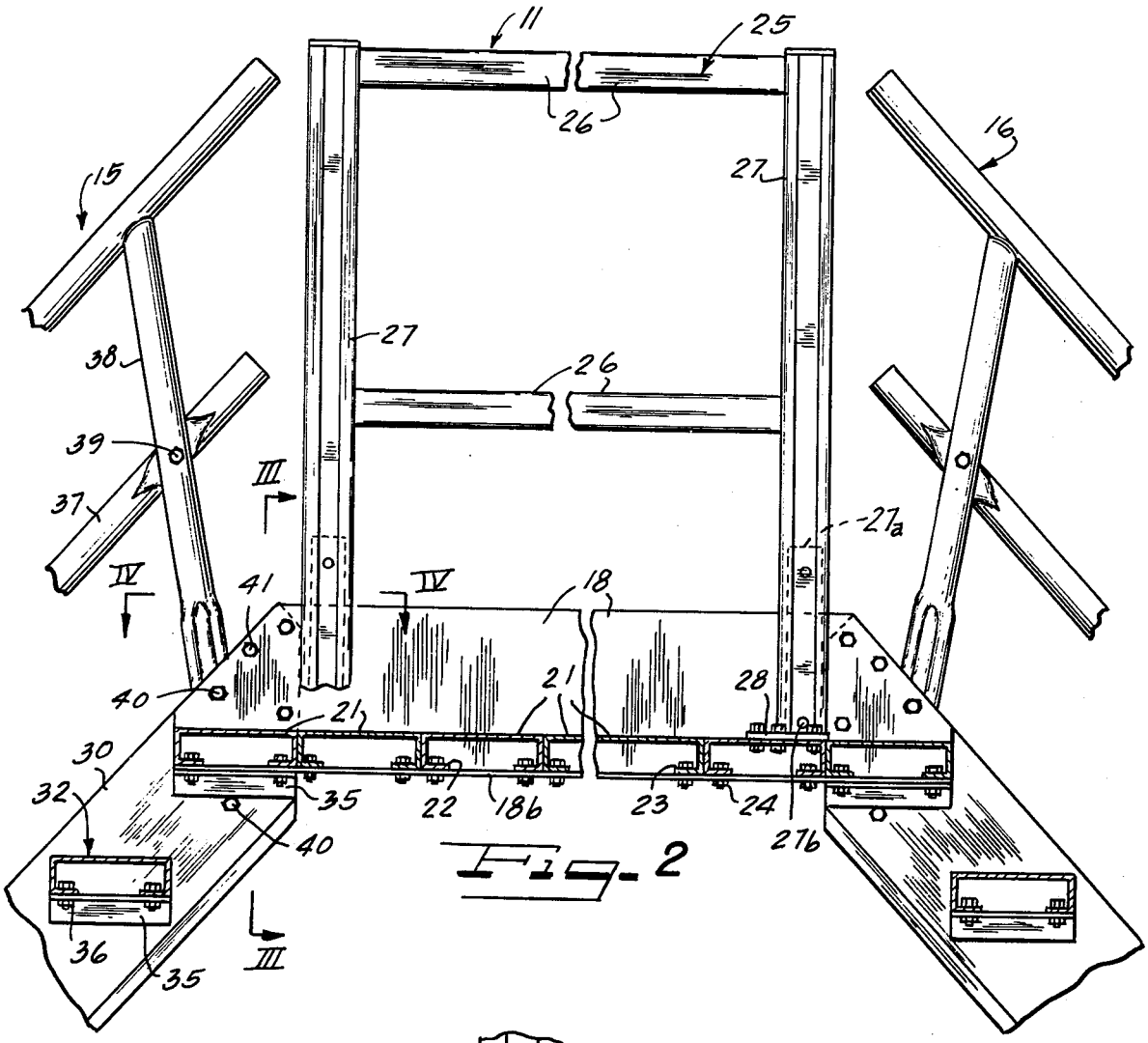
FIG. 2 is an enlarged fragmentary side view of the crossover illustrated in FIG. 1 with portions shown in section.
Figure 3:
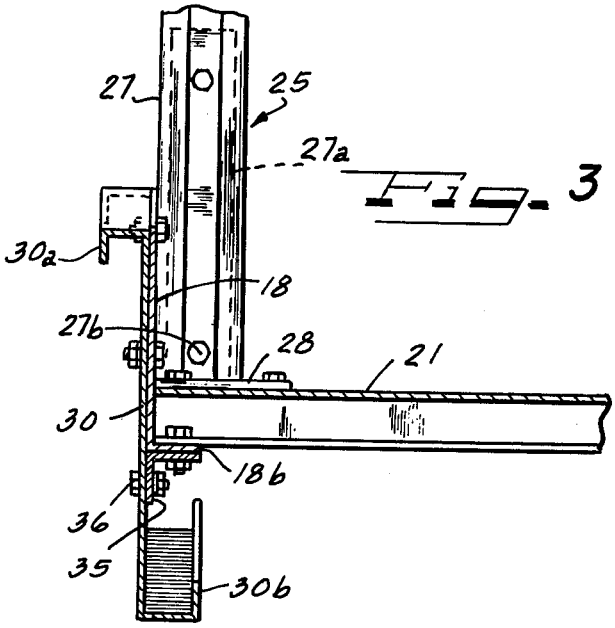
FIG. 3 is an enlarged fragmentary cross-sectional view taken on the line III—III looking in the direction indicated by the arrows as shown in FIG. 2.

At the time of the assembly of the post anchor plate 28 to the transversely extending grating channel 21, it will be seen from FIGS. 2 and 4 that a stub post 27*a* is permanently attached to the support plate 28. Thus, when it is desired to secure the posts 27—27 to the anchor plates 28, the lower ends of the posts are telescoped over the stub posts 27*a*—27*a* and fasteners 27*b* (FIG. 4) are used to permanently connect each telescoped stub post 27*a* and post 27 in assembly together.

The components of the crossover, when shipped can be compactly packed into a few boxes and shipped for installation on a job site. The assembled crossover, if assembled at the manufacturing location would require a large truck to haul the same to an installation site and the movement of the crossover into position at the installation site could be very difficult if it were shipped in this manner.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. In combination, a crossover comprising a bridge section and a pair of angled stairways for connection with opposite ends of said bridge section and with the bridge section disposed in an elevated position relative to bottom ends of said angled stairways when assembled therewith, a pair of transversely spaced main crossover channels positioned at opposite sides of said bridge section, railing structure having lower ends secured at lower end areas to said main crossover channels of said bridge section, a riser panel end section positioned at each end of said channel and comprising a supported side rail of at least one of said stairways, a shelf structure mounted on each riser panel end section supporting said main crossover channels at one of its ends, fasteners joining the opposite ends of each main crossover channel to the associated riser panel end sections securing the main crossover channels in separated relation with the upper ends of said stairways, crossover members positioned between said main crossover channels, and means securing said crossover members in supported assembly with said crossover channels.

2. The combination of claim 1 further characterized by the stairways being attached to opposite ends of the elevated bridge section to provide the sole means of support therefore.

3. The combination of claim 1 further characterized by said stairways having different lengths to accommodate the need to adjust to variations in terrain at opposite ends of the crossover.

4. The combination of claim 1 further characterized by the lengths of the stairways being variable to permit the elevation of the bridge section to be varied as needed.

5. The combination of claim 1 further characterized as including a conveyor and with the stairways being upwardly angled and joined with the bridge section to maintain the main section in supported overlying relation relative to the conveyor.

6. The crossover of claim 1 further characterized by said stairways having stairway railings at opposite sides, a pair of riser panels, a series of steps positioned between said riser panels and each secured at opposite ends therewith, each riser panel having an upper channeled riser margin, spaced upwardly opening slots in said margin, stairway railing structure each having a pair of posts with lower ends extended through said slots, and means securing lower ends of said posts to the associated riser panel.

7. The combination of claim 1 further characterized by the bridge section having a railing structure at opposite sides and in assembly with said crossover channels, said railing structure at one side, including horizontal crossover railing members and vertical crossover railing posts which are secured in assembly together, mounting plates secured to said grating having stub posts extending upwardly therefrom, said railing posts being assembled in telescoped relation with stub posts, and fasteners securing the thus telescoped posts in unitary relation together.

8. A prefabricated knockdown type of crossover comprising an elevated bridge section and a pair of angled stairways each joined with one of a pair of opposite ends of said bridge section, the stairways having a series of ascending steps permitting access to the elevated bridge section and with the bridge section having a grating to allow a person to walk there across, the stairways being attached to opposite ends of the elevated bridge section to suspend the bridge section therebetween and to provide a firm means of support therefore, said stairways having stairway railings at opposite sides, a pair of riser panels, a series of steps positioned between said riser panels and each secured at opposite ends therewith, each riser panel having an upper channeled riser margin, spaced upwardly opening slots in said margin, stairway railing structure each having a pair of posts with lower ends extended through said slots, and means securing lower ends of said posts to the associated riser panel.

9. The combination of claim 8 further characterized by the stairways being attached to opposite ends of the elevated bridge section to provide the sole means of support therefore.

10. The combination of claim 8 further characterized by said stairways having different lengths to accommodate the need to adjust to variations in terrain at opposite ends of the crossover.

11. The combination of claim 8 further characterized by the lengths of the stairways being variable to permit the elevation of the bridge section to be varied as needed.

12. The combination of claim 8 further characterized as including a conveyor and with the stairways being upwardly angled and joined with the bridge section to maintain the main section in supported overlying relation relative to the conveyor.

13. In combination, a crossover comprising a bridge section and a pair of angled stairways for connection with opposite ends of said bridge section and with the bridge section disposed in ah elevated position relative to bottom ends of said angled stairways when assembled therewith, a pair of transversely spaced main crossover channels positioned at opposite sides of said bridge section, railing structure having lower ends secured at lower end areas to said main crossover channels of said bridge section, a riser panel end section positioned at each end of said channel and comprising a supported side rail of at least one of said stairways, a shelf structure mounted on each riser panel end section supporting said main crossover channels at one of its ends, fasteners joining the opposite ends of each main crossover channel to the associated riser panel end sections securing the main crossover channels in separated relation with the upper ends of said stairways, each opposite end of each main crossover channel being disposed in lapped secured assembly with the associated riser panel end section, crossover means positioned between said main crossover channels, and means securing said crossover means in supported assembly with said crossover channels.

14. The combination of claim 13 further characterized by the stairways being attached to opposite ends of the elevated bridge section to provide the sole means of support therefor.

15. The combination of claim 13 further characterized by said stairways having different lengths to accommodate the need to adjust to variations in terrain at opposite ends of the crossover.

16. The combination of claim 13 further characterized by the lengths of the stairways being variable to permit the elevation of the bridge section to be varied as needed.

17. The combination of claim 13 further characterized by the bridge section having a railing structure at opposite sides and in assembly with said crossover channels, said railing structure at one side, including horizontal crossover railing members and vertical crossover railing posts which are secured in assembly together, mounting plates secured to said grating having stub posts extending upwardly therefrom, said railing posts being assembled in telescoped relation with stub posts, and fasteners securing the thus telescoped posts in unitary relation together.

* * * * *